US005526868A

United States Patent [19]

Campbell et al.

[11] Patent Number: 5,526,868

[45] Date of Patent: Jun. 18, 1996

[54] CASTING PROCESS WITH FORCED AND CONTROLLED VORTEX AT SPRUE INTAKE

[75] Inventors: John Campbell, IRC in Materials for High Performance Applications, The University of Birmingham, Edgbaston, Birmingham, B15 2TT, England; Tomoo Isawa, Tokyo, Japan

[73] Assignees: John Campbell, Birmingham, England; NKK Corporation, Tokyo, Japan

[21] Appl. No.: 191,645

[22] Filed: Feb. 4, 1994

[30] Foreign Application Priority Data

Nov. 30, 1993 [JP] Japan ..... 5-300114

[51] Int. Cl.[6] ..... B22C 9/08

[52] U.S. Cl. ..... 164/133; 164/362

[58] Field of Search ..... 164/133, 363, 164/362, 364

[56] References Cited

U.S. PATENT DOCUMENTS 4,987,951 1/1991 Dietrich et al. .

FOREIGN PATENT DOCUMENTS 839414 12/1937 France .

704091 3/1941 Germany .

*Primary Examiner*—Jack W. Lavinder

*Assistant Examiner*—Randolph S. Herrick

*Attorney, Agent, or Firm*—Frishauf, Holtz, Goodman, Langer & Chick

[57] ABSTRACT

A casting process with a forced and controlled vortex at sprue intake comprising imposing rotating motion to molten metal in a pouring basin on a casting mold to create a vortex of molten metal while introducing the molten metal into a cavity, and causing the vortex of molten metal to flow into a sprue along an inner wall thereof so as to create a central vortex core in the molten metal in the sprue while the molten metal is being poured into the sprue.

4 Claims, 8 Drawing Sheets

CASTING PROCESS WITH FORCED AND CONTROLLED VORTEX AT SPRUE INTAKE

BACKGROUND OF THE INVENTION

1. Field of the Invention

The present invention relates to a molten metal casting process capable of producing castings which have few defects.

2. Description of the Related Art

As shown in FIG. 29, a casting mold 1 according to the conventional and basic operating system comprises a bottom mold section 2, a main mold section 3 mounted on the bottom mold section 2, and a top mold section 4 mounted on the main block 3. A sprue 7 and a runner 8 are formed in them. In addition, a cavity 5 shaped to match the shape of castings is formed in the main mold section 3 and the runner 8 is communicated with the cavity 5 through a gate 9. The runner 8 is also communicated with the sprue 7, which is further communicated with a pouring basin 6.

When molten metal is poured into the pouring basin 6 of this casting mold 1, it flows from the pouring basin 6 into the cavity 5, passing through the sprue 7, the runner 8 and the gate 9. In short, it flows through a molten metal passage. A riser or feeder (not shown) is usually arranged in the cavity 5. In addition, a stopper (not shown) and a sprue well 7*c* are sometimes arranged in the molten metal passage to control the flow of molten metal. Molten metal purifying units (not shown) such as a slag separator and a filter are also sometimes arranged in the molten metal passage. Fundamentally, however, the casting mold 1 has the above-mentioned molten metal passage.

The conventional running system, however, has the following problems (1) and (2).

1) In the initial molten metal pouring stage, molten metal rushes into the sprue 7 to thereby cause violent turbulence in the sprue well 7*c*, the runner 8 and that area in the cavity 5 which is adjacent to the gate 9. As a result, the molten metal is oxidized, and atmospheric gas is entrapped into the molten metal. This problem is quite old and various improvements have been proposed to solve it. In the fifties and sixties, studies were vigorously made to optimize the shape of the sprue 7 and to determine other measures at the same time. One of them was to arrange a stopper at a top 7*a* of the sprue 7 to control the amount of molten metal flowing during the initial molten metal pouring stage, while changing the shape of the sprue. It was confirmed, however, by X-ray viewing and other methods conducted at the casting time that the problem could not be completely solved by this proposal. Now, therefore, a recess such as the sprue well 7*c* is formed at a sprue exit 7*b* of the sprue 7. The impact of flowing molten metal is thus softened by the sprue well 7*c* to reduce the turbulence at the initial molten metal pouring stage.

2) In the common casting process, optimum casting speeds (including the speed of molten metal flowing into the cavity) are set experientially or by considering the surface tension of molten metal and the speed thereof. When the speed of flowing molten metal becomes higher than 0.5 m per second in the casting of molten aluminum, for example, the momentum of molten aluminum cannot be restrained by the surface tension thereof. The result is that the oxide film on the surface of moving molten aluminum meniscus breaks allowing further oxidation of the molten aluminum.

In the gravity casting process (which is the easiest and least expensive casting process particularly when an optimum-designed casting mold as shown in FIG. 2 is used), the difference $H_0$ between heads of molten metal in the pouring basin and in the cavity becomes gradually smaller, gradually slowing the speed of molten metal as the casting process advances. It is therefore difficult, in this gravity casting process, to maintain the optimum casting conditions from the beginning of molten metal pouring stage to the end thereof. It is also quite difficult particularly in a large-sized casting to control the speed of flowing molten metal. Specific measures such as vacuum-assisted casting have been proposed to solve these drawbacks but they cannot become common when their equipment cost, their running manner, and their limit to the large-sized casting are considered.

SUMMARY OF THE INVENTION

The object of the present invention is therefore to provide a molten metal casting process capable of keeping the speed of flowing molten metal substantially constant from the beginning of molten metal pouring stage to the end thereof and also capable of producing castings that have few defects.

Inventors of the present invention observed the flow of molten metal in the sprue and the runner using X-ray radiography and water modeling. On the basis of their findings, they were able to prevent severe turbulence at the initial molten metal pouring stage. They have found that turbulence can be reduced when the molten metal is initially introduced into the sprue by controlling the effective head difference $H_0$. This is accomplished by forming a central vortex core in the flowing molten metal in the sprue when the molten metal is introduced into the sprue, by causing the metal to whirl or rotate in the sprue along the inner wall thereof.

According to an aspect of the present invention, there can be provided a casting process wherein a forced and controlled vortex is formed at the sprue intake. The method involves causing a rotating motion in the molten metal in a pouring basin on a casting mold whereby a vortex is formed in the molten metal as it flows into the sprue on its way into a cavity. The vortex is formed in the sprue along the inner wall thereof so as to create a central vortex core in the molten metal in the sprue during the time that the molten metal flows into the sprue.

It is desirable in this case to erect the sprue, which is connected to the pouring basin on the casting mold, to be substantially vertical in the casting mold; to partition the pouring basin into a molten metal pouring area, which is continuous to the sprue, and a molten metal staying area; to form the molten metal pouring area in such a shape that it enables molten metal to be guided in a tangential direction into the sprue when viewing the sprue horizontally sectioned; to pour molten metal into the molten metal staying area; to introduce it from the molten metal staying area into the molten metal pouring area; to add rotating force to it to create a vortex of molten metal while guiding it in the pouring area; to guide the vortex of molten metal to a sprue entrance; to cause it to flow into the sprue along the inner wall thereof through the sprue entrance to create a central vortex core in the sprue during the time that the metal is being poured into the sprue; to cause it to flow through a runner and a gate in the casting mold; and to introduce it into a cavity in the casting mold.

When molten metal is to be introduced into the sprue at the initial pouring stage, the molten metal which advances to the sprue is caused to flow in a spiral into the sprue along the inner wall thereof. The imposed rotating motion on the liquid metal generates centrifugal forces that press the liquid metal against the inner wall of the sprue.

When the rotating motion is imposed on the molten metal 90 in the sprue 17, the free (or top) surface of the molten metal which is adjacent to the sprue entrance 17*a* recesses deeply to form and a cylindrical or conical hollow (or central vortex core) 92, as shown in FIG. 1. The molten metal head difference in the case of the present invention, therefore, can be represented by a distance $H_1$ between the bottom of the center vortex core 92 and the top of the molten metal in the cavity 15, as shown in FIG. 1, while it is represented in the conventional case by the distance $H_0$ between the top of the molten metal in the pouring basin 6 and that of the molten metal in the cavity 5, as shown in FIG. 2. The molten metal can be thus prevented from flowing via the gate into the mold cavity at high speed at the initial moments of pouring. The height different $H_1$ does not greatly change during the pour. Thus the speed of flowing molten metal can be therefore kept as optimum as intended from the beginning of molten metal pouring stage to the end thereof.

Further, density difference separation of inclusions in the melt can be enhanced to a greater extent and impurities such as slag which has a specific gravity smaller than that of molten metal can be thus more easily separated from the molten metal 90, because centrifugal force is added to the molten metal 90 in the sprue 17. In other words, the entering of impurities into the cavity 5 can be more effectively prevented and castings which have few non-metallic impurities in them are produced. Impurities are generally denser than the liquid metal, and are therefore found to be centrifuged into the center of the vortex, and finally float to the center of the top of the sprue as the casting is filled.

Still further, a forced and controlled vortex is formed at the initial molten metal pouring stage, into the molten metal 90 flowing in the sprue 17. Turbulence in the molten metal in the sprue well 17*c* thereby reduced at the initial pouring stage and unnecessary oxidizing of the molten metal and unnecessary trapping of gas in the molten metal can be prevented accordingly. In addition, the cylindrical hollow in the center of the molten metal in the sprue can serve as a passage through which bubbles generated in the lower portion of the sprue at the initial pouring stage can escape. These bubbles can be thus prevented from entering into the castings produced.

Relating to controlling the amount of flowing molten metal, it has been found that the moving of the molten metal head can be controlled by the vortex core 92 which is generated in the center of the molten metal in the sprue and that the speed of the molten metal 90 flowing into the cavity 15 can be thus controlled. The molten metal head difference $H_1$ in the present case becomes smaller than $H_0$ in the conventional case and it can be kept substantially controlled throughout the molten metal pouring stage under much improved control. It is desirable in this case that the rotating motion imposed on the molten metal is sufficient to form the deep central vortex core 92 in the molten metal in the sprue 17.

The flow of molten metal from the sprue into the runner will be described referring to FIGS. 3 through 5.

FIG. 3 shows a forward flow type sprue well which represents a structure of the sprue 17 and the runner 18 in which the rotating flow of molten metal in the sprue 17 is directed to the running direction of the runner 18.

FIG. 4 shows a backward flow type sprue well which denotes another structure of the sprue 17 and the runner 18 in which the rotating flow of molten metal in the sprue 17 is directed reverse to the running direction of the runner 18. In the case of this reversed flow type sprue well, the momentum of molten metal flowing into the runner 18 can be reduced and the speed of molten metal flowing into the cavity 15 (shown in FIG. 1) can be thus controlled.

FIG. 5 shows a mixed flow type sprue well. This mixed flow type sprue well can be positioned intermediate between the forward and the backward flow type sprue wells, which represents a further structure of the sprue 17 and the runner 18 in which the rotating flow of molten metal in the sprue 17 is directed neither to the running direction of the runner 18 nor reverse to it.

The reverse flow type (FIG. 4) has an additional merit that non-metallic inclusions of low specific gravity generated in the pouring basin 16 or brought from the molten metal holding furnace can be collected and floated into a region of the central vortex core 92 (see FIG. 1) not to allow them to enter the cavity 15. As well known, this can be seen also in the case of the slag separator of the cyclone type. The tangentially connected runner (FIG. 3) tends to direct all material immediately into the runner, prior to the head $H_1$ (FIG. 1) being generated. Thus the benefits of the cleaning action of the centrifugal effect are less evident at an early stage of pouring.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENTS

The casting process according to the present invention will be described in detail with reference to the drawings.

EXAMPLE 1

Small-Sized Aluminum Casting

The casting process was carried out under the following conditions to cast small-sized aluminum castings.

Figure 3:
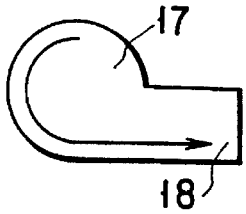
FIG. 3 shows a sprue well of one type which is tangentially continuous to a runner.
Figure 5:
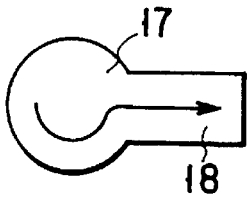
FIG. 5 shows the sprue well of a further type which is continuous and symmetrically arranged with respect to the runner.
Figure 6:
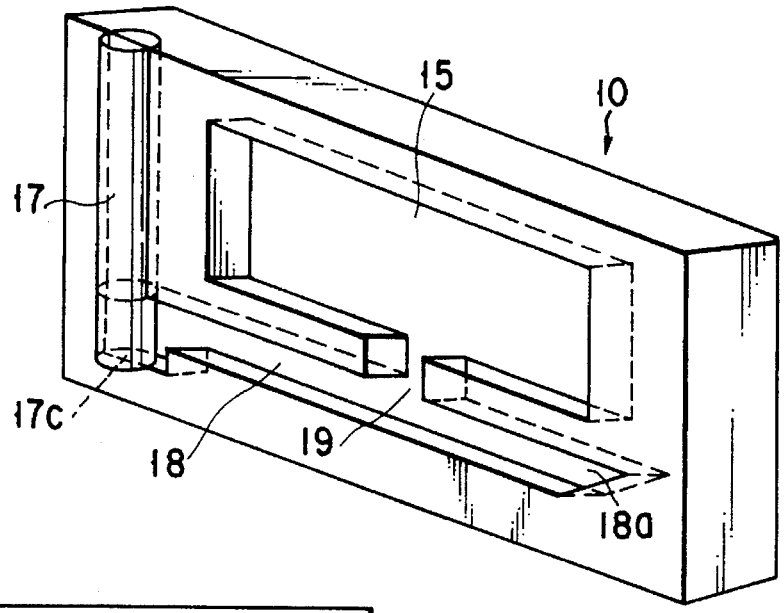
FIG. 6 is a perspective view showing a casting mold which is used to carry out the molten metal casting process according to a first embodiment of the present invention.
Figure 7:
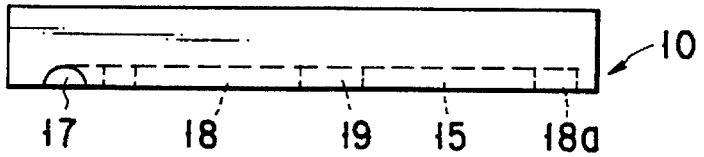
FIG. 7 is a plan showing a half of the casting mold which is used to carry out the molten metal casting process according to the first embodiment of the present invention.
Figure 8:
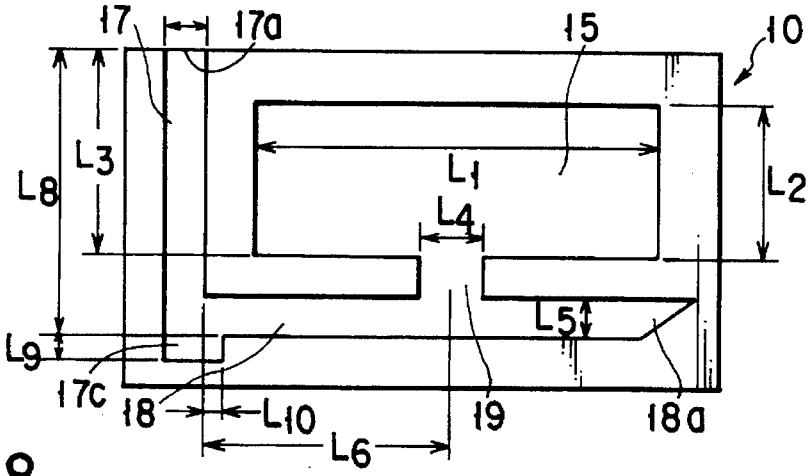
FIG. 8 is a vertically-sectioned view showing the casting mold which is used to carry out the molten metal casting process according to the first embodiment of the present invention.

A sand mold 10 shown in FIGS. 6 through 8 was made and molten aluminum was cast in it. A sprue well 17*c* of a sprue 17 was connected to a runner 18 according to three types of connecting manner shown in FIGS. 3 through 5. This is because the rotating direction of molten metal affects the running state of it when the rotating flow of it in the sprue 17 runs into the runner 18. Test was made relating to the sprue well 17*c* and the runner 18 which were connected to each other according to these three different connecting manner.

The sand mold 10 had the following sizes. Length $L_1$ of a cavity 15: 200 mm, height $L_2$ of the cavity 15: 75 mm, level difference $L_3$ between a sprue entrance 17*a* and the bottom of the cavity 15: 100 mm, width $L_4$ of a gate (or ingate) 19: 30 mm (length of the gate 19: 25 mm), diameter $L_5$ of the runner 18: 20 mm, length $L_6$ of the runner 18 extending from the sprue well 17*c* of the sprue 17 to the center of the gate 19: 100 mm, diameter $L_7$ of the sprue 17: 20 mm, length $L_8$ of the sprue 17 extending from the sprue entrance 17*a* to the bottom of the runner 18: 145 mm, depth $L_9$ of the sprue well 17*c* measured from the bottom of the runner 18: 10 mm, and length $L_{10}$ of the sprue well 17*c* which was projected from the sprue 17 into the runner 18: 10 mm. A feeder (not shown) was communicated with the cavity 15.

Some kinds of pouring basins will be described with reference to FIGS. 9 through 12.

Figure 9:
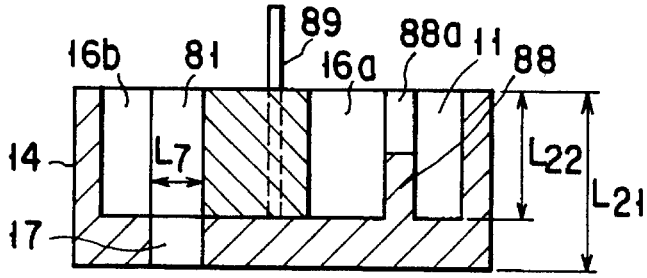
FIG. 9 is a vertically-sectioned view showing a pouring basin according to the present invention.
Figure 10:
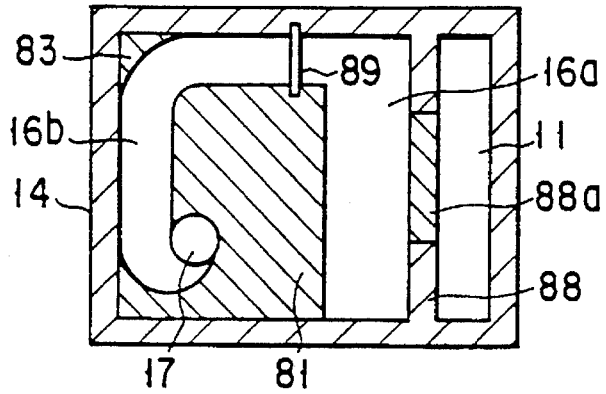
FIG. 10 is a plan showing the pouring basin.

As shown in FIGS. 9 and 10, the mold shown has a specifically-designed pouring basin 14 on the top thereof. This pouring basin 14 is designed to cause the molten metal to flow in the sprue 17 in such a way that the molten metal has a circular flow in the sprue 17 when viewing the sprue 17 horizontally. More specifically, the pouring basin 14 is separated into three areas 11, 16*a* and 16*b*. The first area 11 serves as an overflow area, the second area 16*a* as a staying area, and the third area 16*b* as a pouring area. This arrangement was convenient for research purposes. Clearly simpler arrangements using fewer separated compartments may be convenient for production use. This consideration applies to all the examples below.

The first area 11 is separated from the second area 16*a* by a gate 88 and when the top level of molten metal in the second area 16*a* becomes higher than a predetermined value, molten metal flows from the second area 16*a* into the first area 11, passing over a recess 88*a* of the gate 88, to keep the top level of molten metal in the second area 16*a* constant.

The second area 16*a* is separated from the third area 16*b* by a partition block 81 and a stopper 89 and it receives molten metal from a molten metal supply unit (not shown).

When the present invention is to be embodied, it is desirable to form the overflow area 11 and use the stopper 89. However, these overflow area 11 and stopper 89 are not essential. In short, the present invention can be realized without them.

The use of stopper is preferable but not always necessary.

The third area 16*b* communicates with the sprue 17 and it serves as an area by which molten metal is guided into the sprue 17. The sprue 17 is located, remote from the stopper 89, in the third area 16*b*.

The molten metal passage extending from the second area 16*a* to the third area 16*b* is defined by the inner wall of the pouring basin 14 and the partition block 81. As shown in FIG. 10, the partition block 81 forms about half the circumference of the sprue 17 entrance in the third area 16*b*. A piece 83 provides a smooth curve at a first corner of the third area 16*b* and a part of the partition block 81 provides another smooth curve at a second corner thereof. Molten metal flowing there can be thus rotated smoothly. About half the circumference of the sprue 17 entrance is made open to the molten metal guiding passage 16*b* of the pouring basin 14 in this case.

In FIG. 10, the partition block 81 at the second corner is shown in contact with the outer circumference of the sprue 17, while keeping its radius constant, but the partition block can also be formed with a decreasing radius.

Referring to FIG. 9, length $L_{21}$ of the pouring basin 14 was 70 mm and depth $L_{22}$ of each of the three areas 11, 16*a* and 16*c* was 54 mm.

Figure 11:
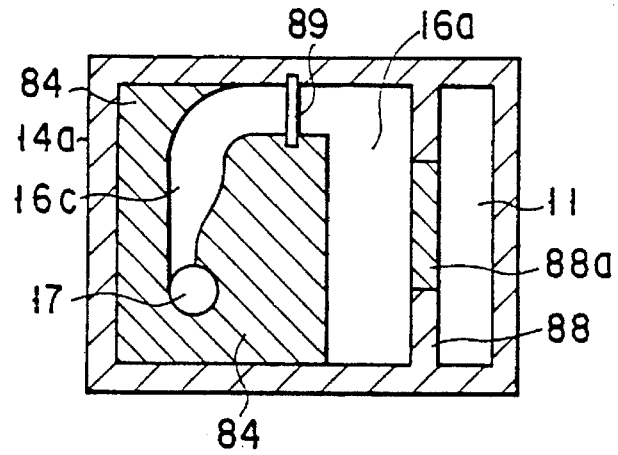
FIG. 11 is a plan showing another pouring basin according to the present invention.

As shown in FIG. 11, a partition block 84 may form about ⅔ or up to ¾ of the sprue entrance in a third area 16*c* of another pouring basin 14*a*. One side of the partition block 84 which defines the third area 16*c* is accorded substantially with the tangent of the sprue 17. Molten metal flowing in the third area 16*c* can be thus rotated smoothly. About ¼ or ⅓ of the sprue entrance 17*a* is made open, in this case, to the third area 16*c* acting as a molten metal guiding passage for the pouring basin 14*a*.

Figure 12:
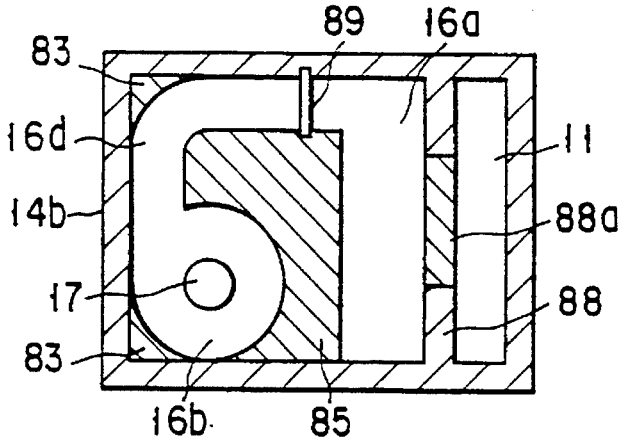
FIG. 12 is a plan showing a further pouring basin according to the present invention.

As shown in FIG. 12, a partition block 85 may enclose the sprue entrance in a third area 16*d* of a further pouring basin 14*b*, with a certain distance interposed between them. A piece 83 provides a smooth curve at a first corner of the third area 16*d* and another piece 83 also provides a smooth curve at a second corner thereof in this case. Molten metal flowing there can be thus rotated smoothly.

Figure 13:
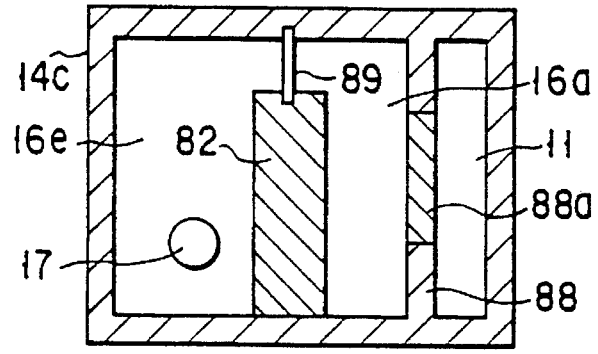
PRIOR ART FIG. 13
FIG. 13 is a plan showing a pouring basin which is used as a comparison example.

FIG. 13 is a plan showing a conventional pouring basin 14*c* in which the second area 16*a* is partitioned from a third area 16*e* by a plate-like partition block 82. This pouring basin 14*c* is shown here as an example to be compared with the above-described pouring basins of the present invention.

Figure 1:
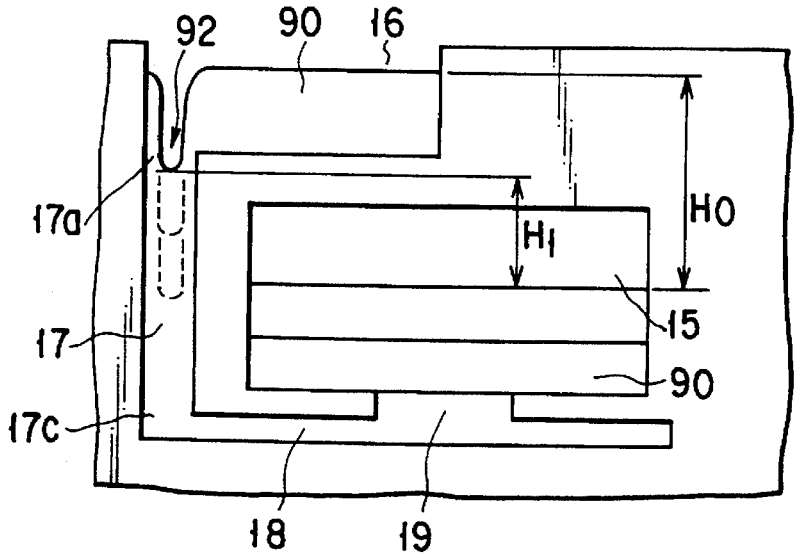
FIG. 1 is a sectional view schematically showing a casting mold used to carry out the molten metal casting process according to the present invention.
Figure 2:
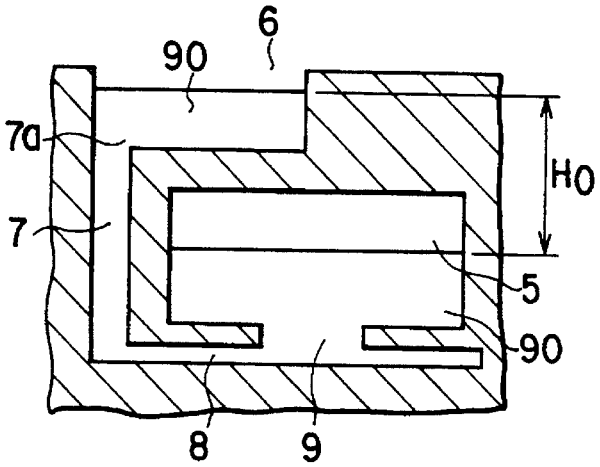
PRIOR ART FIG. 2
FIG. 2 is a sectional view schematically showing a conventional casting mold which is used as a comparison example.

Referring to FIGS. 10–12, molten metal is allowed to flow from the second area 16*a* into the third area 16*b*, 16*c* or 16*d*, it rotates while being guided by the inner wall of the pouring basin 14, 14*a* or 14*b* and the partition block 81, 84 or 85. It then flows into the sprue 17 through the sprue entrance 17*a* and falls like a spiral in the sprue 17. As a result of the rotating motion imposed on it an air column (or vortex core) 92 (shown in FIG. 1) is formed in the center of it in the sprue 17. It can flow, therefore, gently into the cavity 15 (FIG. 1) without creating any vortex when it passes through the runner 18 and the gate 19.

The flowing state of molten metal in the sprue well and in the runner was checked and compared with that in the comparison example. Results thus obtained will be described referring to FIGS. 14 through 19.

Pouring basins 14, 14*a* and 14*b* shown in FIGS. 10, 11 and 12 were used. Pouring temperature was 700° C. and molten aluminum having a predetermined temperature was directed into each of the pouring basins on the top of the mold. While supplying molten aluminum to the pouring basin to keep the molten aluminum head fixed, the stopper was pulled up and molten metal was poured into the sprue 17. A sprue most suitable for carrying out a conventional process in which no vortex action was introduced, and the pouring basin shown in FIG. 13 were used in the comparison example.

A CCD camera was used to record, from above, the state of molten metal poured and molten metal itself in the pouring basin. Further, X rays were shot through the side of the casting mold to clearly view the inside. The flow of molten metal and the progress of filling in the casting mold were thus observed. After this casting test, the casting in the sand mold was left and cooled in atmosphere. Non-destructive testing was then conducted by X rays, paying attention to internal defects in the casting, particularly to gaseous defects in the casting which were caused by the entrainment of air.

Test Results

Figure 14:
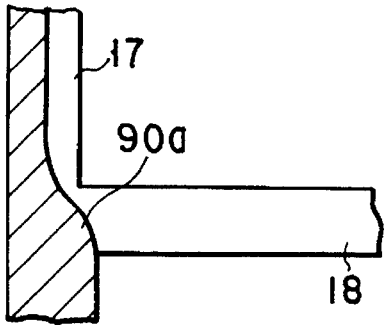
FIG. 14 shows the flow of molten metal flowing from the sprue into the runner when the molten metal is poured into the casting mold according to the present invention.
Figure 15:
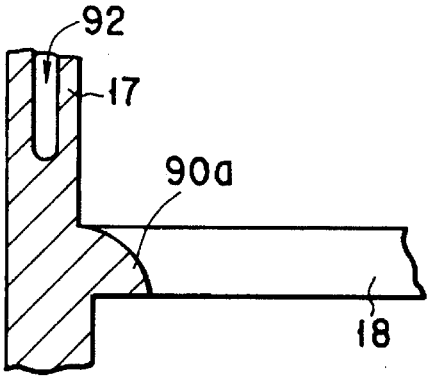
FIG. 15 shows the flow of molten metal flowing from the sprue into the runner when the molten metal is poured into the casting mold according to the present invention.
Figure 16:
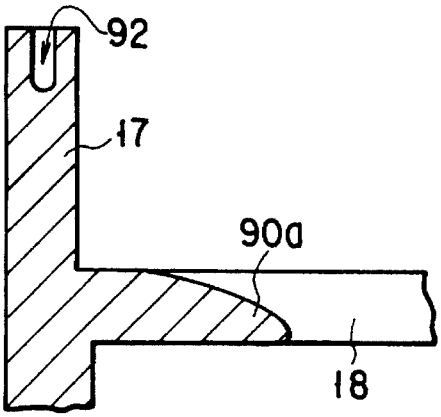
FIG. 16 shows the flow of molten metal flowing from the sprue into the runner when the molten metal is poured into the casting mold according to the present invention.

As shown in FIGS. 14 through 16, the rotating flow of molten metal and its central vortex in the sprue 17 were confirmed in all of the specific pouring basins according to the present invention. It was also confirmed by X ray observation that the flow rate of molten metal in the runner 18, the splash of molten metal, and the flowing speed of molten metal into the cavity 15 (see FIG. 1) could be controlled. As apparent from FIGS. 14 through 16, splash is not caused in molten metal flowing in the sprue 17, the sprue well 17*c* (FIG. 1) or the runner 18. In short, the front 90*a* of molten metal moves gently into the runner 18 along the bottom thereof.

Figure 17:
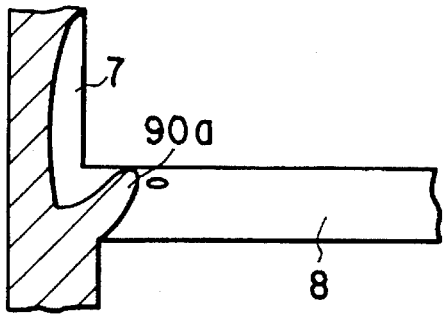
PRIOR ART FIG. 17
FIG. 17 shows the flow of molten metal flowing from the sprue into the runner when the molten metal is poured into the conventional casting mold.
Figure 18:
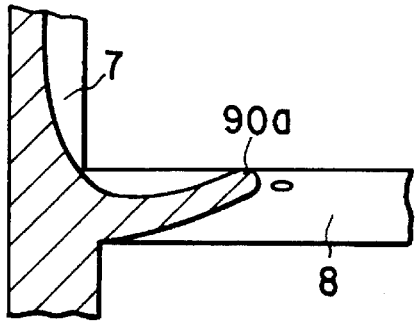
PRIOR ART FIG. 18
FIG. 18 shows the flow of molten metal flowing from the sprue into the runner when the molten metal is poured into the conventional casting mold.
Figure 19:
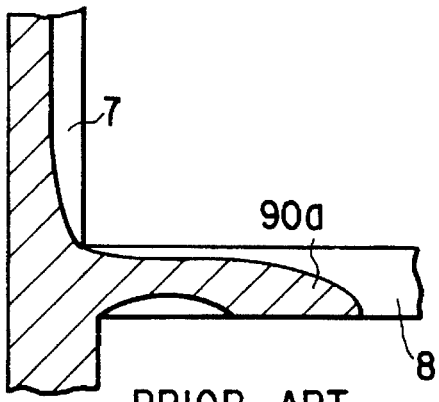
PRIOR ART FIG. 19
FIG. 19 shows the flow of molten metal flowing from the sprue into the runner when the molten metal is poured into the conventional casting mold.

In the pouring basin of the traditionally-filled comparison example, however, it was confirmed, as shown in FIGS. 17 through 19, that the moving front 90*a* of molten metal struck against the top wall of the runner 18 and disintegrated into splashes. It was also checked that the entrainment of air and the splash of molten metal were caused in the gate (cf gate 19 of FIG. 1).

Particularly in the pouring basin 14*b* shown in FIG. 12, the flow rate of molten metal, the splash and the flowing speed of it could be controlled to the optimum extent. More particularly when the pouring basin 14*b* was combined with the backward flow type sprue well shown in FIG. 4, that is, when the rotating flow of molten metal in the sprue well 17*c* is reverse to the running direction of the runner 18, these controls could be made easiest.

Figure 20:
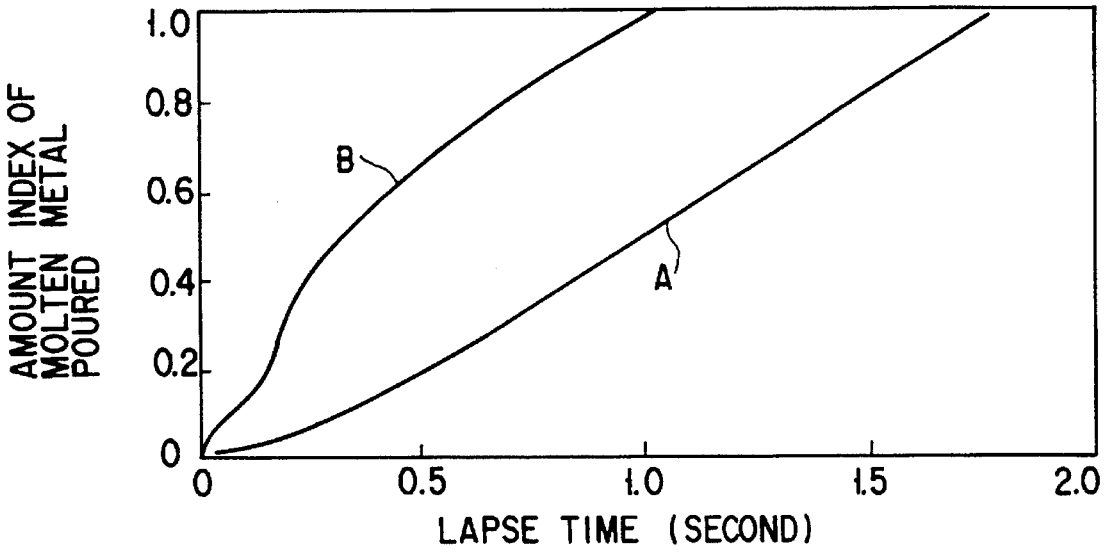
FIG. 20 is a graph showing the relation of time to the amount of molten metal poured in the cavity.

In FIG. 20, lapse time after the start of casting is plotted on the horizontal axis and amount of molten metal poured on the vertical axis. In short, results obtained in the pouring basins of the present invention which are represented by the curve A are compared, in FIG. 20, with those obtained in the pouring basin of the traditional comparison example which are represented by the curve B. An amount index of molten metal poured is defined by the amount of molten metal occupying the cavity 15. It represents an index obtained when the volume of molten metal in the cavity is divided by the total volume of the cavity (when the index is 1, the cavity is filled with molten metal). As shown by the curve A, the amount of molten metal poured is kept substantially constant throughout the casting process, that is, from the start of casting to the end thereof and it satisfies the optimum flowing-in condition. In the case of results obtained in the comparison example, however, the head of molten metal becomes smaller as the amount of molten metal poured becomes relatively larger. The rate of flow of molten metal into the cavity is thus progressively reduced.

Figure 21:
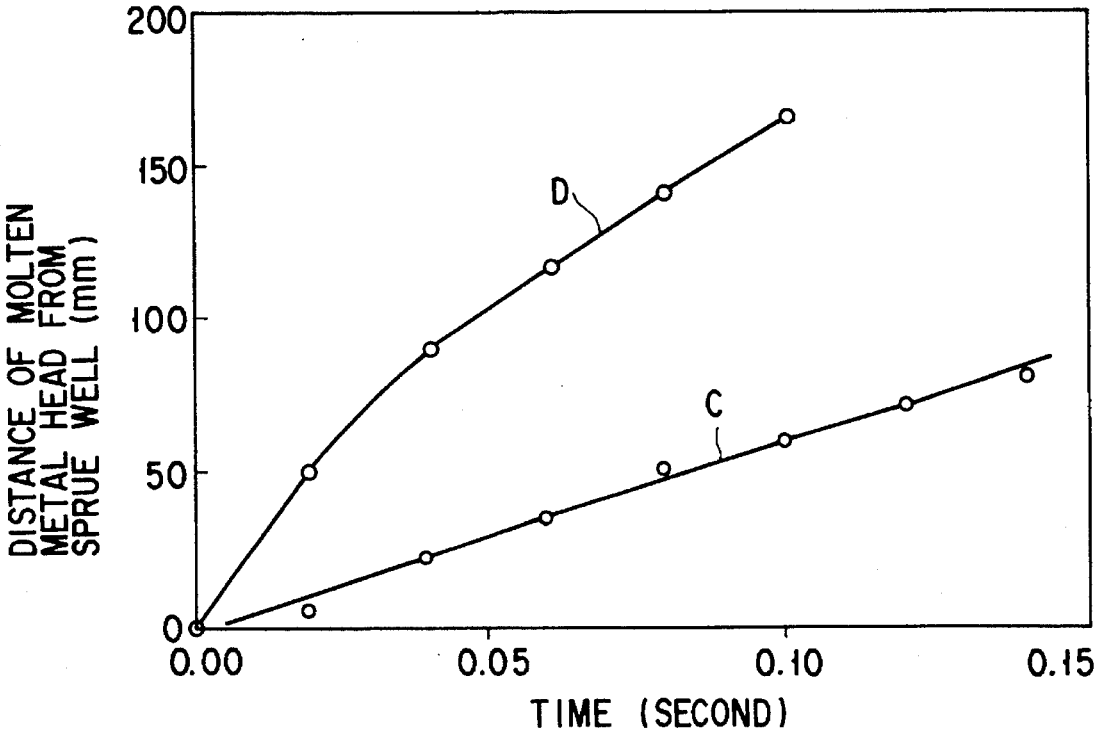
FIG. 21 is a graph showing the speed at which the front of molten metal progressed along the runner.

FIG. 21 is a graph showing the velocity at which the front 90*a* of molten metal moves in the runner 18. In FIG. 21, time is plotted on the horizontal axis and the distance of the front 90*a* of molten metal from the sprue well on the vertical axis. Thus, the slope of the graph shows the velocity of the flow shown by the slope of curve C, the velocity of molten metal moving in the runner 18 could be is low in the case of the present invention. In the case of the traditional comparison example, however, the velocity of the moving front 90*a* of molten metal in the runner 18 is very high in the initial period of the casting process, as shown by the slope of curve D.

EXAMPLE 2

Metal Matrix Composite Casting

Metal matrix composite was cast under the following conditions.

Casting material was an aluminum alloy in which particles of silicon carbide powder were contained at a level of 15 volume %. The mold was same as that used in the test example 1. By the traditional casting approach, it was quite difficult to cast this composite material. This is because the apparent viscosity of this material is quite high. Once air is entrained in the molten metal, which usually happens when the molten metal is being poured, it cannot escape and thus is left in the casting.

Figure 4:
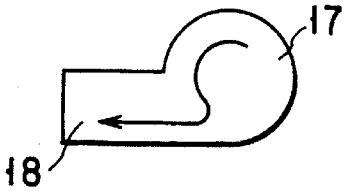
FIG. 4 shows the sprue well of another type which is anti-tangentially continuous to the runner.

The temperature of molten metal was 750° C. and the pouring basin 14*b* which had been confirmed as optimum in the test example 1 was used together with the sprue well of the backward flow type shown in FIG. 4. The conventional pouring basin shown in FIG. 13 was used as a comparison example. The test was conducted using two plate-like cavities arranged vertically and horizontally.

Figure 22:
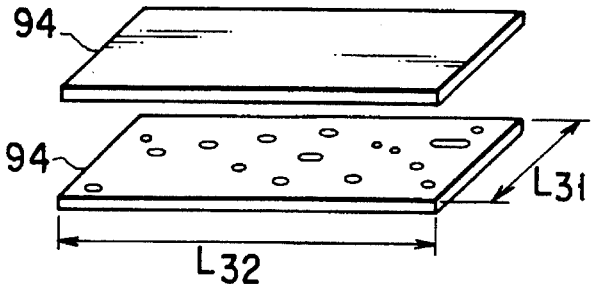
FIG. 22 shows pieces cut from castings to check the percentage of porosity (porosity ratio) present in them, respectively.

Castings were vertically cut as thin pieces 94, as shown in FIG. 22, and porosity ratio μ was calculated by dividing the total area of porosity in each piece 94 by the cut face area of the piece 94. Results thus obtained in the case of the present invention were compared with those obtained in the case of the conventional example.

The porosity fraction μ can be obtained by the following equation (1), providing that the total area of porosity is denoted s.

$$\mu = s/(L_{31} \cdot L_{32}) \quad (1)$$

Test Results

Figure 23:
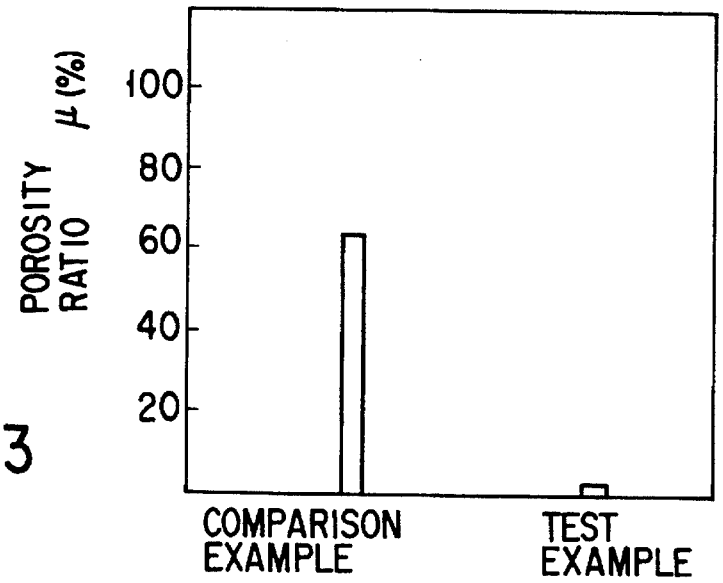
FIG. 23 is a graph showing the porosity ratio thus obtained.
Figure 24:
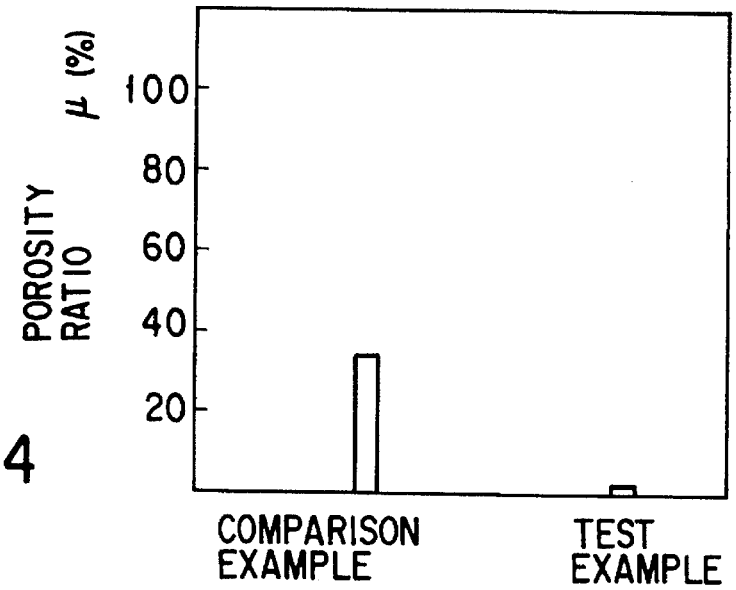
FIG. 24 is a graph showing the porosity ratio thus obtained, respectively.

The porosity fraction μ obtained in the case of the present invention was remarkably different from that obtained in the case of the conventional example, as shown in FIGS. 23 and 24. The porosity ratio μ obtained in the test example 2 was almost zero in both cases where the plate-like cavities were arranged vertical and horizontal, but the porosity ratio μ obtained in the comparison example was about 60% in the case where the plate-like cavity was arranged vertically and about 35–40% in the case where the cavity was arranged horizontally. Results shown in FIG. 23 were obtained when the cavity was arranged vertical and those shown in FIG. 24 were obtained when the cavity was arranged horizontally.

EXAMPLE 3

Large-Sized Aluminum Casting

Large-sized aluminum casting was conducted under the following conditions.

Figure 25:
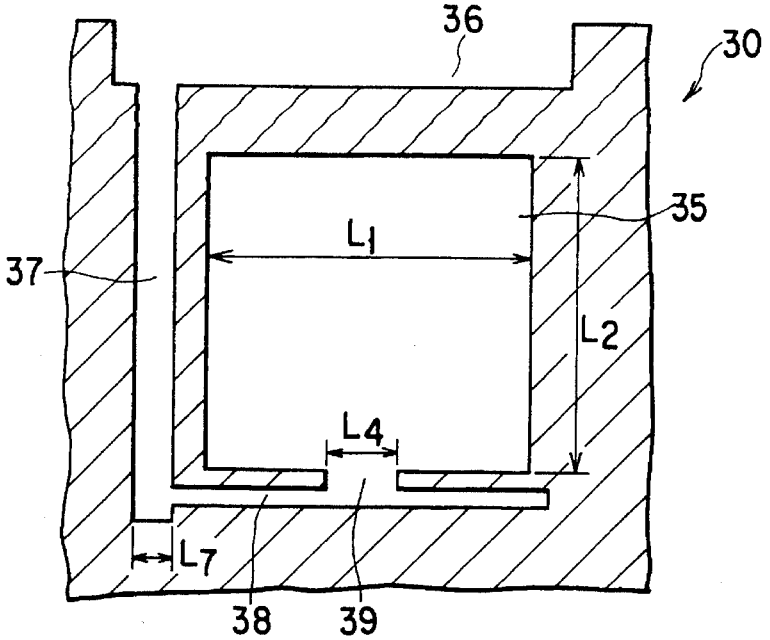
FIG. 25 is a sectional view showing a further casting mold which is used to carry out the molten metal casting process.

A cavity 35 shown in FIG. 25 was 400 mm long (length $L_1$), 400 mm high (height $L_2$) and 15 mm wide. Diameter $L_7$ of a sprue 37 was 30 mm and gate width $L_4$ of a gate 39 was 100 mm.

Aluminum plates each having a size of 400 mm×400 mm×15 mm were cast using a mold 30 which had the above-mentioned cavity 35, sprue 37 and gate 39. The pouring basin 14*b* (See FIG. 12) was used, in the test example 3, together with the sprue 37 and a runner 38 of the backward flow type (See FIG. 4). The traditional mold having the pouring basin 14*c* was used as a comparison example. Commercially pure aluminum was cast at 700° C.

Each of castings thus obtained was equally divided into three upper, center and lower portions. The porosity fraction μ in each cut face of these three portions was measured. Three-point bending test was also conducted on these portions to check aluminum oxides dispersed in them.

Test Results

Figure 26:
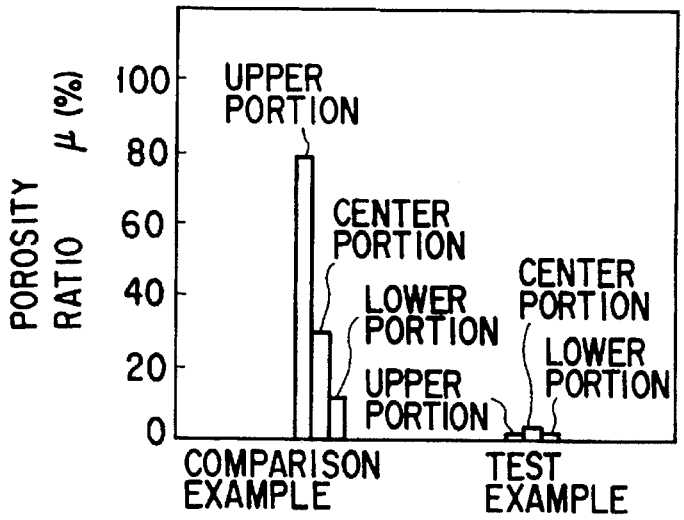
FIG. 26 is a graph showing porosity ratio obtained, respectively.

FIG. 26 shows the porosity ratio μ obtained, respectively. The porosity rations μ obtained in three portions of the test example 3 were quite small but those obtained in three portions of the comparison example were high or about 80% particularly in the upper portion thereof, although the running system of the comparison example was thought to be optimized until then.

Figure 27:
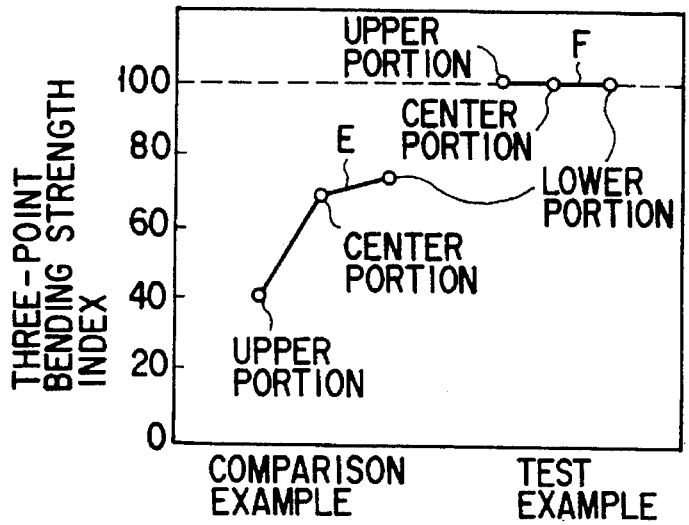
FIG. 27 is a graph showing results obtained by the three-point bending test.

FIG. 27 shows three-point bending test results. The curve E represents results in the comparison example and the curve F those obtained in the test example. Similar to the porosity fraction μ results above, the upper portion of the comparison example showed a value of about 40%, and the center and lower portions thereof showed a value of about 70%, as seen in the case of the small-sized casting test, at the initial stage of pouring during which the speed of flowing molten metal is high. The test casting carried out according to the present invention was shown here to have a value of 100%. This casting was a sample cut from a large casting that had, in addition, been confirmed as being substantially fully dense by X-ray radiography testing.

EXAMPLE 4

Cast Iron Casting

Cast iron casting was conducted under the following conditions.

The mold was the same as that in example 3. The pouring basin 14*b* shown in FIG. 12 was used together with the sprue well of the reverse flow type shown in FIG. 4. The conventional casting mold having the pouring basin 14*c* shown in FIG. 13 was used as a comparison example. The porosity fraction μ were checked in each casting.

Test Results

Figure 28:
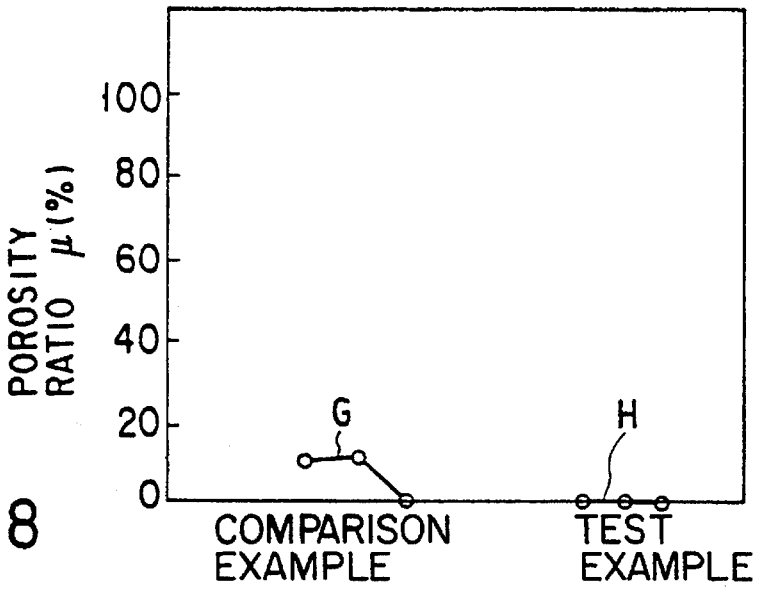
FIG. 28 is a graph showing porosity ratio obtained, respectively.
Figure 29:
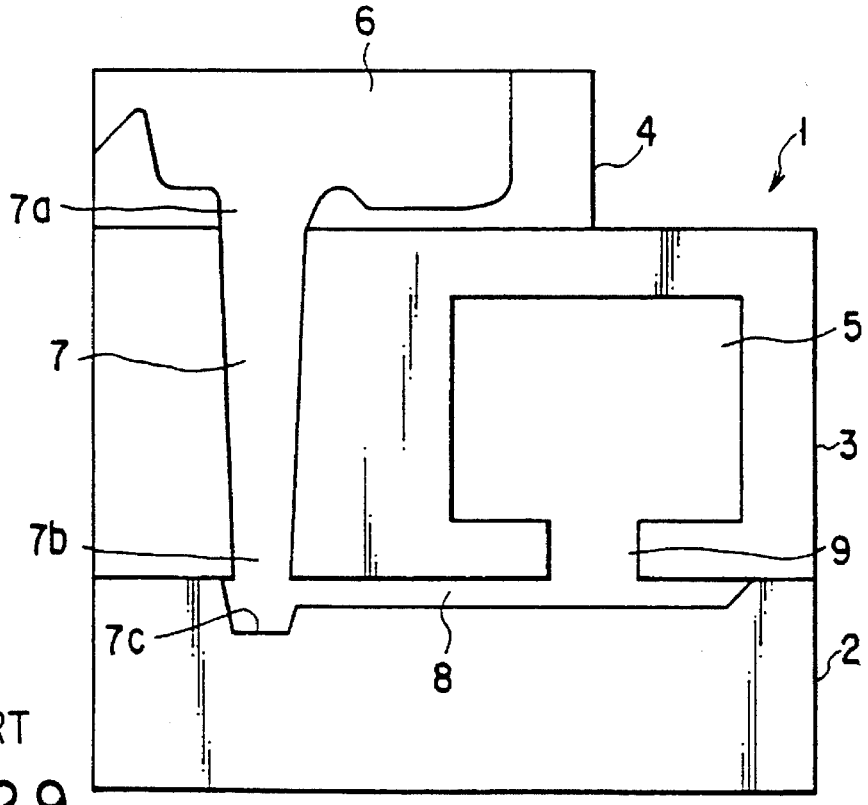
PRIOR ART FIG. 29
FIG. 29 is a vertically-sectioned view showing a casting mold which is used to carry out the conventional metal casting process.

FIG. 28 shows the porosity results which were obtained. As shown by the curve H, the porosity was low in each of three portions of the test example, but it was high in the upper portion of the comparison example, as shown by the curve G, although the running system of the comparison example was thought to be optimized until then.

According to the present invention, casting can be carried out while keeping the inflow speed of molten metal substantially constant from the beginning of casting to the end thereof. The castings thus produced have significantly reduced porosity.

Additional advantages and modifications will readily occur to those skilled in the art. Therefore, the invention in its broader aspects is not limited to the specific details, and illustrated examples shown and described herein. Accordingly, various modifications may be made without departing from the spirit or scope of the general inventive concept as defined by the appended claims and their equivalents.

What is claimed is:

1. A method of casting molten metal comprising;

(a) forming a sprue which is substantially vertical and communicates with a pouring basin and with a runner;

(b) partitioning said pouring basin into a molten metal-pouring area and a molten metal staying area;

(c) forming at least one smooth corner portion within said molten metal-pouring area to change smoothly the flowing direction of molten metal within the molten metal-pouring area;

(d) supplying a molten metal into the molten metal-staying area; and (e) introducing said molten metal from the metal-staying area into the molten metal-pouring area, the flowing direction of the molten metal being changed at said smooth corner portion of the molten metal-pouring area, and also changed in the same direction when the molten metal flows into the sprue;

wherein the molten metal continues to flow along a peripheral region of the sprue so as to create a whirling stream within the sprue, and further flows from within the sprue into a runner and, then, into a cavity through a gate.

2. The casting method according to claim 1, wherein the molten metal-pouring area of the pouring basin is formed in such a way that ⅓ to ½ of the outer circumference of the sprue entrance is made open to the molten metal pouring area to increase the rotating force which is added to the molten metal flowing from the pouring basin into the sprue.

3. The casting method according to claim 1, wherein the molten metal-pouring area of the pouring basin is formed in such a way that ¼ to ⅓ of the outer circumference of the sprue entrance is made open to the molten metal pouring area to increase the rotating force which is added to the molten metal flowing from the pouring basin into the sprue.

4. The casting method according to claim 2, wherein a sprue well at the bottom of the sprue and the runner are positioned to cause the flowing direction of the molten metal to be made opposite to the whirling direction within the sprue when the molten metal flows from within the sprue into the runner, thereby causing the flowing velocity of the molten metal to be lowered at said sprue well such that a flowing velocity of the molten metal into said runner decreases.

* * * * *